US012258733B2

(12) United States Patent
Kang

(10) Patent No.: US 12,258,733 B2
(45) Date of Patent: Mar. 25, 2025

(54) CONSTRUCTION MACHINE

(71) Applicant: HD HYUNDAI INFRACORE CO., LTD., Incheon (KR)

(72) Inventor: Byung Il Kang, Incheon (KR)

(73) Assignee: HD HYUNDAI INFRACORE CO., LTD., Incheon (KR)

( * ) Notice: Subject to any disclaimer, the term of this patent is extended or adjusted under 35 U.S.C. 154(b) by 546 days.

(21) Appl. No.: 16/606,363

(22) PCT Filed: Apr. 18, 2018

(86) PCT No.: PCT/KR2018/004474
§ 371 (c)(1),
(2) Date: Mar. 28, 2023

(87) PCT Pub. No.: WO2018/194357
PCT Pub. Date: Oct. 25, 2018

(65) Prior Publication Data

US 2023/0228061 A1 Jul. 20, 2023

(30) Foreign Application Priority Data

Apr. 18, 2017 (KR) ..... 10-2017-0049981

(51) Int. Cl.
*E02F 9/22* (2006.01)
*E02F 9/12* (2006.01)

(52) U.S. Cl.
CPC ..... *E02F 9/2217* (2013.01); *E02F 9/123* (2013.01); *E02F 9/2296* (2013.01)

(58) Field of Classification Search
CPC .. F15B 1/02; F15B 2211/88; F15B 2211/205; F15B 2211/625; F15B 2211/7058; E02F 9/2217; E02F 9/2296
See application file for complete search history.

(56) References Cited

U.S. PATENT DOCUMENTS 8,826,656 B2 9/2014 Ueda et al.
9,068,575 B2 6/2015 Zhang et al.
(Continued)

FOREIGN PATENT DOCUMENTS

CN 103534419 A 1/2014
CN 103703257 A 4/2014
(Continued)

OTHER PUBLICATIONS

International Search Report dated Sep. 11, 2018, in connection with counterpart International Patent Application No. PCT/KR2018/004474.

(Continued)

*Primary Examiner* — Thomas E Lazo
(74) *Attorney, Agent, or Firm* — Hauptman Ham, LLP

(57) ABSTRACT

The present invention is related to a construction machine, the construction machine including: a main pump; a swing motor operated by the main pump; a swing valve configured to control flow of the hydraulic oil by the main pump to supply the hydraulic oil to the swing motor and to control the flow of the hydraulic oil having been discharged from the swing motor; a hydraulic oil control valve unit configured to control the flow of the hydraulic oil according to a pressure of the hydraulic oil at opposite ends; a first accumulator configured to store the hydraulic oil when the swing motor is decelerated; a regeneration control valve provided between the hydraulic oil control valve unit and the first accumulator; and a controller configured to control the hydraulic oil control valve unit and the regeneration control valve by determining acceleration or deceleration of the swing motor.

8 Claims, 7 Drawing Sheets

(56) References Cited

U.S. PATENT DOCUMENTS

| | | | | |
|---|---|---|---|---|
| 2014/0013753 | A1* | 1/2014 | Ueda | E02F 9/123 60/706 |
| 2014/0174064 | A1* | 6/2014 | Ma | F15B 1/024 60/327 |
| 2014/0174069 | A1* | 6/2014 | Kuehn | F15B 21/14 60/459 |
| 2014/0208728 | A1 | 7/2014 | Ma et al. | |
| 2015/0225928 | A1* | 8/2015 | Wu | E02F 9/2278 60/413 |
| 2016/0010663 | A1 | 1/2016 | Zhang et al. | |
| 2016/0238041 | A1 | 8/2016 | Kajita et al. | |
| 2016/0281329 | A1 | 9/2016 | Shang et al. | |
| 2016/0281745 | A1* | 9/2016 | Shang | F02N 7/00 |

FOREIGN PATENT DOCUMENTS

| | | | |
|---|---|---|---|
| EP | 2 913 443 | A1 | 9/2015 |
| JP | S54158404 | U | 11/1979 |
| JP | 2007-191283 | A | 8/2007 |
| KR | 10-1998-0022862 | A | 7/1998 |
| KR | 10-0157275 | B1 | 11/1998 |
| KR | 10-2015-0077431 | A | 7/2015 |
| KR | 10-2016-0015630 | A | 2/2016 |
| WO | 2016056442 | A1 | 4/2016 |

OTHER PUBLICATIONS

Extended European Search Report dated May 15, 2020 in connection with the counterpart European Patent Application No. EP18788458.0.

Official Action issued on Sep. 6, 2023, for corresponding European Patent Application No. 18 788 458.0 (7 Pages).

Chinese Office Action issued on Mar. 10, 2021, in connection with the Chinese Patent Application No. 201880026003.9.

* cited by examiner

Fig. 4

| Swing direction | Mode | Operation unit signal | Swing motor pressure | Delta p (L2-L1) Or (R2-R1) |
|---|---|---|---|---|
| Left | Acceleration | Left | L2 > R2 | R2 > R1 |
| | Deceleration | Left | L2 < R2 | R2 > R1 |
| | Deceleration/ Reverse lever | Right | L2 < R2 | R2 > R1 |
| Right | Acceleration | Right | L2 < R2 | L2 > L1 |
| | Deceleration | Right | L2 > R2 | L2 > L1 |
| | Deceleration/ Reverse lever | Left | L2 > R2 | L2 > L1 |

CONSTRUCTION MACHINE

CROSS REFERENCE TO RELATED APPLICATION

This present application is a national stage filing under 35 U.S.C § 371 of PCT application number PCT/KR2018/004474 filed on Apr. 18, 2018 which is based upon and claims the benefit of priority to Korean Patent Application No. 10-2017-0049981 filed on Apr. 18, 2017 in the Korean Intellectual Property Office. The disclosures of the above-listed applications are hereby incorporated by reference herein in their entirety.

TECHNICAL FIELD

The present disclosure relates to a construction machine, and more specifically, to a construction machine capable of storing and utilizing inertial energy of a swing body.

DISCUSSION OF RELATED ART

In general, a construction machine includes a traveling body and a swing body which is supported by the traveling body and is rotatable. The traveling body, which is for moving the construction machine, may include a caterpillar track or a wheel. In addition, the swing body is provided with a cabin, on the traveling body, in which a driver can sit and operate the construction machine. Then, the driver rotates the swing body to operate work tools, such as a bucket, provided at the swing body, and performs works such as mining using the construction machine.

As illustrated in FIGS. 1 and 2, in a swing deceleration section of the construction machine, a pressure of an operation unit is not controlled to zero but controlled to maintain a certain level of pressure. Specifically, FIG. 2 shows a pressure and a swing speed of a swing operation unit of an operation unit 310, a pressure B on an inflow side of a swing motor 200, a pressure A on a discharge side of the swing motor 200, and an area change of a swing valve 300.

When the swing body decelerates, the operator operates the operation unit 310, e.g., joystick, and continues to perform control without putting the swing valve 300 in neutral (arrow A). In such a case, the pressure of the operation unit 310 is controlled to a certain level, not zero. When the flow rate discharged from the swing motor 200 reaches a relief pressure of the swing motor, a swing relief valve 110 and a check valve are open, and the flow rate is supplied to an introduction side of the swing motor 200 again. That is, the swing motor 200 is replenished from the tank by the drainage amount of the flow rate of the swing motor 200. In addition, a hydraulic oil supplied from a main pump 100 and having been discharged from the swing motor 200 passes through the swing valve 300 and is discharged into the tank.

In addition, in the swing deceleration section, when the controller 310 is controlled to select an excavation position of the construction machine, since the flow rate of the hydraulic oil having been discharged from the swing motor 200 has become less when the swing speed is sufficiently decelerated, an insufficiently small spool valve flow path of the swing valve 300 may lead to a case (arrow C) where the pressure of the swing motor 200 is lower than the pressure of the swing relief valve 110 at the time of swing deceleration.

SUMMARY

Embodiments of the present invention provides a construction machine that can utilize energy of a hydraulic oil by storing the hydraulic oil discharged from a swing motor at the time of deceleration or acceleration of a swing body.

Technical Solution to the Problem

According to an embodiment, a construction machine includes: a main pump; a swing motor operated by receiving a hydraulic oil from the main pump; a swing valve configured to control flow of the hydraulic oil by the main pump to supply the hydraulic oil to the swing motor and to control the flow of the hydraulic oil having been discharged from the swing motor; a hydraulic oil control valve unit provided between the swing motor and the swing valve and configured to control the flow of the hydraulic oil according to a pressure of the hydraulic oil at opposite ends; a first accumulator configured to store the hydraulic oil having passed through the hydraulic oil control valve unit when the swing motor is decelerated; a regeneration control valve provided between the hydraulic oil control valve unit and the first accumulator; and a controller configured to control the hydraulic oil control valve unit and the regeneration control valve by determining acceleration or deceleration of the swing motor.

In an embodiment, the construction machine may further include: a first pressure detection member provided between the swing motor and the swing valve and configured to detect a pressure of the hydraulic oil flowing into the swing motor; and a second pressure detection member configured to detect a pressure discharged from the swing motor.

In an embodiment, the construction machine may further include: an operation unit operated by an operator and configured to control a rotation direction and a rotation speed of the swing motor. The controller may determine acceleration or deceleration of the swing motor based on an operation direction of the operation unit, the pressure detected by the first pressure detection member, and the pressure detected by the second pressure detection member.

In an embodiment, the construction machine may further include: a first orifice provided between the second pressure detection member and the swing valve, the hydraulic oil passing through the first orifice; and a third pressure detection member provided between the first orifice and the swing valve.

In an embodiment, the controller may calculate a flow rate of the swing motor based on the pressure of the hydraulic oil detected by the second pressure detection member and the third pressure detection member and a preset area of the first orifice.

In an embodiment, the construction machine may further include: a storage pressure detection member configured to detect a pressure of the hydraulic oil stored in the first accumulator.

In an embodiment, the hydraulic oil control valve unit may include: a hydraulic oil switch valve member selectively switched according to the pressure of the hydraulic oil discharged from the swing motor and the pressure of the hydraulic oil supplied to the swing motor; and a first hydraulic oil opening and closing valve member configured to selectively supply the hydraulic oil to the first accumulator or the swing valve according to the pressure of the hydraulic oil having been discharged from the swing motor and passing through the hydraulic oil switch valve member.

In an embodiment, the controller may calculate an outlet pressure of the swing motor based on the calculated flow rate of the swing motor and a preset area of the swing valve so as to control the regeneration control valve based on a difference between the calculated outlet pressure of the swing motor and the pressure of the first accumulator.

In an embodiment, when the calculated outlet pressure of the swing motor is higher than the pressure of the first accumulator, the controller may close the first hydraulic oil opening and closing valve member, and control the regeneration control valve so that a pressure loss corresponding to the difference between the calculated outlet pressure of the swing motor and the pressure of the hydraulic oil of the first accumulator occurs.

In an embodiment, when the calculated outlet pressure of the swing motor is less than the pressure of the first accumulator, the controller may control the first hydraulic oil opening and closing valve member or the second hydraulic oil opening and closing valve member so that the hydraulic oil having been discharged from the swing motor flows to the swing valve.

In an embodiment, the construction machine may further include: a second accumulator capable of storing the hydraulic oil having passed through the hydraulic oil control valve unit when the swing motor accelerates.

According to an embodiment, a construction machine includes: a main pump; a swing motor operated by receiving a hydraulic oil from the main pump; a swing valve configured to control flow of the hydraulic oil by the main pump to supply the hydraulic oil to the swing motor and to control the flow of the hydraulic oil having been discharged from the swing motor; a hydraulic oil control valve unit provided between the swing motor and the swing valve and configured to control the flow of the hydraulic oil according to a pressure of the hydraulic oil at opposite ends; a flow rate detection member provided between the swing motor and the hydraulic oil control valve unit; a first accumulator configured to store the hydraulic oil having passed through the hydraulic oil control valve unit when the swing motor is decelerated; a regeneration control valve provided between the hydraulic oil control valve unit and the first accumulator; and a controller configured to calculate an outlet pressure of the swing motor based on a flow rate of the hydraulic oil detected by the flow rate detection member and an area of the swing valve and to control the regeneration control valve based on a difference between the calculated outlet pressure of the swing motor and a pressure of the first accumulator.

Effects of the Invention

A construction machine can effectively use energy of a hydraulic oil by storing the hydraulic oil having been discharged from a swing motor at the time of deceleration or acceleration of a swing body.

BRIEF DESCRIPTION OF THE DRAWINGS

FIG. 4 shows a table for determining an operation state of a swing motor of a controller according to an embodiment of the present invention;

DETAILED DESCRIPTION

Figure 1:
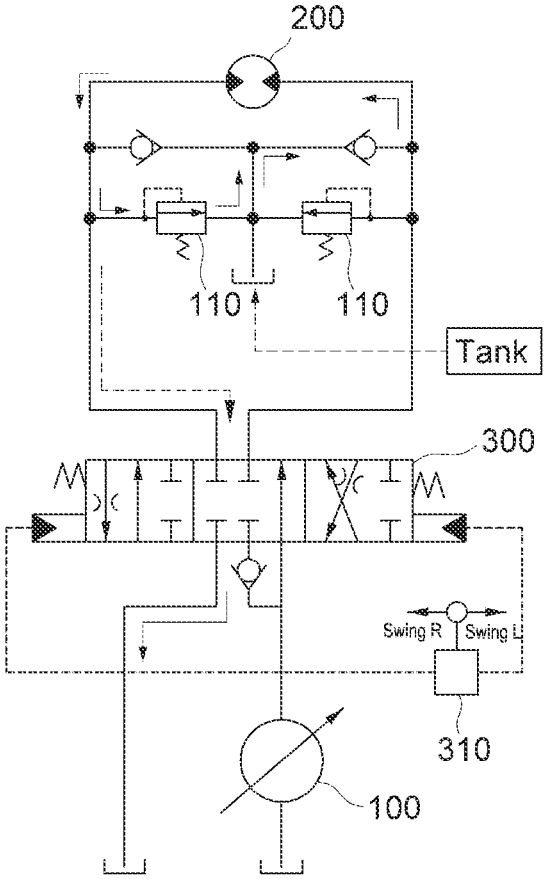
FIG. 1 is a view illustrating a conventional construction machine.

Hereinafter, embodiments of the present invention will be described specifically with reference to the accompanying drawings so that those skilled in the art may easily implement the present invention. The present invention may be implemented in various ways and is not limited to the embodiments described herein.

It is noted that the figures are schematic and not drawn to scale. The relative dimensions and ratios of the parts in the figures are exaggerated or reduced in size for clarity and convenience and any dimensions are merely exemplary and not limiting. The same reference numerals are used to refer to similar features in the same structure, element or part illustrated in more than one figure.

Embodiments of the present invention specifically illustrate desired embodiments of the invention. Accordingly, various modifications of the drawings are expected. Thus, the embodiment is not limited to the specific form of the illustrated region, but includes, for example, modification of the form by manufacture.

Embodiments of the present invention specifically illustrate ideal embodiments of the present invention. As a result, various modifications of the drawings are expected. Thus, the embodiment is not limited to the specific form of the illustrated region, and includes, for example, modification of the form by manufacture.

Hereinafter, a construction machine 101 according to an embodiment of the present invention will be described with reference to FIGS. 3 to 5.

Figure 3:
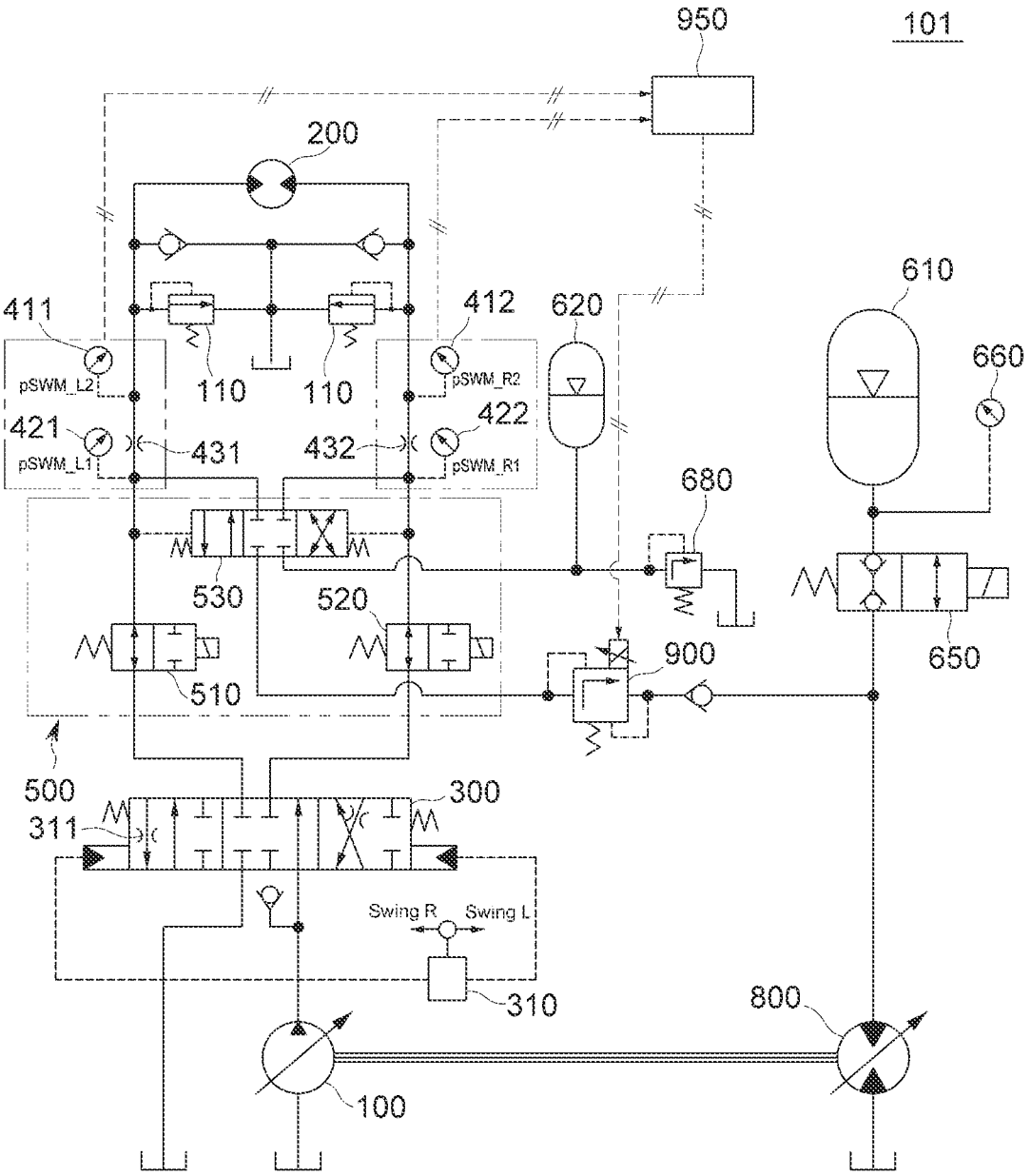
FIG. 3 is a view illustrating a construction machine according to an embodiment of the present invention.

A construction machine 101 according to an embodiment of the present invention, as illustrated in FIG. 3, includes a main pump 100, a swing motor 200, a swing valve 300, a hydraulic oil control valve unit 500, a first accumulator 610, and a controller 950.

The main pump 100 receives an oil from a tank, adds a pressure to the oil, and generates a hydraulic oil with pressure to drive devices. That is, the main pump 100 allows the oil provided from the tank to have energy for driving the devices.

The swing motor 200 is operated by receiving the hydraulic oil from the main pump 100. Specifically, the swing motor 200 allows a swing body, provided on a traveling body of the construction machine 101, to perform a swing movement.

The swing valve 300 controls the flow of the hydraulic oil by the main pump 100 to supply the hydraulic oil to the swing motor 200. Specifically, the swing valve 300 is provided between the main pump 100 and the swing motor 200 and allows the hydraulic oil supplied from the main pump 100 to be supplied to the swing motor 200 and the hydraulic oil having passed through the swing motor 200 to be discharged to the tank.

The hydraulic oil control valve unit 500 controls the flow of the hydraulic oil according to a pressure of the hydraulic oil discharged from the swing motor 200. Specifically, the hydraulic oil control valv1e unit 500 may be switched according to the pressures of the hydraulic oil flowing into the swing motor 200 and the hydraulic oil having been discharged from the swing motor 200.

That is, the hydraulic oil control valve unit 500 is switched according to the pressure of the hydraulic oil flowing into the swing motor 200 and the pressure of the hydraulic oil discharged from the swing motor 200, thereby controlling the flow of the hydraulic oil having been discharged from the swing motor 200. In addition, the hydraulic oil control valve unit 500 may control the flow of the hydraulic oil so that the hydraulic oil having been discharged from the swing motor 200 may be discharged to the tank through the swing valve 300.

The first accumulator 610 may store the hydraulic oil that has passed through the hydraulic oil control valve unit 500 when the swing motor 200 is decelerated. That is, the hydraulic oil control valve unit 500 may allow the hydraulic oil that has passed through the swing motor 200 to be supplied to the first accumulator 610.

A regeneration control valve 900 is provided between the hydraulic oil control valve unit 500 and the first accumulator 610. Specifically, the regeneration control valve 900 may be provided in front of the first accumulator 610. In addition, the regeneration control valve 900 may guide the hydraulic oil that has passed through a hydraulic oil switch valve member 530 to be stored in the first accumulator 610 when the swing motor 200 is decelerated. Accordingly, the construction machine 101 according to an embodiment of the present invention may store the hydraulic oil, discharged from the swing motor 200, in the first accumulator 610, when the swing motor 200 is decelerated.

The controller 950 determines acceleration or deceleration of the swing motor 200 to control the hydraulic oil control valve unit 500 and the regeneration control valve 900. Specifically, the controller 950 may determine a deceleration state or an acceleration state of the swing motor 200 based on the information on rotation direction of the swing motor 200 currently selected by the operator and by comparing the current pressure applied to the swing motor 200 and the pressure discharged from the swing motor 200.

In addition, the construction machine 101 according to an embodiment of the present invention may further include a second accumulator 620.

The second accumulator 620 may supply the stored hydraulic oil to the swing motor 200 when the swing motor 200 is decelerated. Specifically, the second accumulator 620 supplies the hydraulic oil stored in the second accumulator 620 toward the inflow side of the swing motor 200 while the hydraulic oil having passed through the swing motor 200 is stored in the first accumulator 610 when the swing motor 200 is decelerated, thereby preventing cavitation of the inflow side of the swing motor 200. That is, since the hydraulic oil having been discharged from the swing motor 200 is stored in the first accumulator 610 when the swing motor 200 is decelerated, the hydraulic oil is not supplied to the inflow side of the swing motor 200 while the swing motor 200 rotates, and thus cavitation may occur on the inflow side of the swing motor 200.

Accordingly, in a case where the hydraulic oil having passed through the swing motor 200 is stored in the first accumulator 610 when the swing motor 200 is decelerated, the second accumulator 620 may supply the hydraulic oil of the swing motor 200, which is discharged and stored during acceleration of the swing motor 200, toward the inflow side of the swing motor 200, thereby capable of preventing cavitation from occurring at the inflow side of the swing motor 200.

That is, in a case where the hydraulic oil having passed through the swing motor 200 is stored in the first accumulator 610 when the swing motor 200 is decelerated, the hydraulic oil stored in the second accumulator 620 when the swing motor 200 is accelerated may be supplied to the swing motor 200. In such a case, cavitation that may be caused by the lack of flow rate supplied to the inflow side of the swing motor 200 may be efficiently prevented.

In addition, the second accumulator 620 of the construction machine 101 according to an embodiment of the present invention may store the hydraulic oil having passed through the swing motor 200 when the swing motor 200 is accelerated. Specifically, the second accumulator 620 may store the hydraulic oil having passed through the hydraulic oil control valve unit 500 when the swing motor 200 is accelerated. That is, the hydraulic oil control valve unit 500 may allow the hydraulic oil having passed through the swing motor 200 to be supplied to the second accumulator 620, when the swing motor 200 is accelerated.

Accordingly, the construction machine 101 may store and utilize the hydraulic oil thereof in the first accumulator 610 or the second accumulator 620 at the time of deceleration or acceleration of the swing motor 200.

In addition, the construction machine 101 according to an embodiment of the present invention may further include a first pressure detection member 412 and a second pressure detection member 411. The first pressure detection member 412 and the second pressure detection member 411 may detect a pressure of the hydraulic oil flowing into the swing motor 200 and a pressure of the hydraulic oil discharged from the swing motor 200. Specifically, the first pressure detection member 412 and the second pressure detection member 411 may be provided between the swing motor 200 and the hydraulic oil control valve unit 500.

For example, when the swing motor 200 swings as illustrated in FIG. 3, the first pressure detection member 412 may detect the pressure of the hydraulic oil flowing into the swing motor 200. Specifically, the first pressure detection member 412 may be disposed on a hydraulic line in front of the swing motor 200 to detect the pressure of the hydraulic oil flowing into the swing motor 200.

The second pressure detection member 411 may detect the pressure of the hydraulic oil discharged from the swing motor 200. Specifically, the second pressure detection member 411 may be disposed on the hydraulic line behind the swing motor 200 to detect the pressure of the hydraulic oil discharged from the swing motor 200.

The above-described position in front of or behind the swing motor 200 is defined based on the flow of the hydraulic oil supplied to the swing motor 200.

In addition, the construction machine 101 according to an embodiment of the present invention may further include the operation unit 310.

The operation unit 310 may be operated by an operator and may control a rotation direction and a rotation speed of the swing motor 200. Specifically, the operator may selectively operate a direction of the operation unit (joystick) 310 to determine a rotation direction of the swing motor 200. In addition, the operator may selectively operate an operation amount of the operation unit 310 to control the acceleration or deceleration speed of the swing motor 200.

The controller 950 may receive information of the operation unit 310 operated by the operator. In addition, the controller 950 may determine acceleration or deceleration of the swing motor 200 based on the information of the operation unit 310, the pressure detected by the first pressure detection member 412, and the pressure detected by the second pressure detection member 411. Specifically, the controller 950 may determine the acceleration state of the swing motor 200 or the deceleration state of the swing motor 200 based on the rotation direction information of the operation unit 310 currently selected by the operator according to the information of the operation unit 310 and by comparing the pressure currently flowing into the swing motor 200 and the pressure discharged from the swing motor 200.

For example, as illustrated in FIG. 3, the first pressure detection member 412 may be disposed on the right side of the swing motor 200, and the second pressure detection member 411 may be disposed on the left side of the swing motor 200. In sch an embodiment, in a case where the rotation direction of the swing motor 200 is selected to the right by the operation unit 310 operated by the operator, when a pressure R2 detected by the first pressure detection member 412 is higher than a pressure L2 detected by the second pressure detection member 411, the swing motor 200 may be determined to be in an acceleration state.

On the other hand, as illustrated in FIGS. 3 and 4, in a case where the rotation direction of the swing motor 200 is selected to the right by the operation unit 310 operated by the operator, when the pressure L2 detected by the second pressure detection member 411 is higher than the pressure R2 detected by the first pressure detection member 412, the swing motor 200 may be determined to be in a deceleration state.

FIGS. 3 and 4 illustrate a rotation direction of the swing motor 200, a signal of the operation unit 310 input by the operator, and a difference between the pressure flowing into or discharged out of the swing motor 200. That is, the controller 950 may determine a deceleration or acceleration state of the swing motor 200 by comparing the pressure R2 detected by the first pressure detection member 421 and the pressure R1 detected by the second pressure detection member 411 based on the information of the operation unit 310 selected by the operator.

In addition, the construction machine 101 according to an embodiment of the present invention may further include a first orifice 431 and a third pressure detection member 421.

The hydraulic oil whose pressure has been detected by the first pressure detection member 412 may pass through the first orifice 431. Specifically, the first orifice 431 may be provided on the hydraulic line behind the swing motor 200. That is, the second pressure detection member 411 may detect the pressure of the hydraulic oil discharged from the swing motor 200 and flowing into the first orifice 431.

The third pressure detection member 421 may detect the pressure of the hydraulic oil having passed through the first orifice 431. That is, the third pressure detection member 421 may detect the pressure of the hydraulic oil having been discharged from the swing motor 200 and passed through the first orifice 431.

In addition, the controller 950 of the construction machine 101 according to an embodiment of the present invention may calculate a flow rate of the swing motor 200. Specifically, the controller 950 may calculate the flow rate Q of the hydraulic oil discharged from the swing motor 200.

The controller 950 may calculate the flow rate Q of the swing motor 200 discharged from the swing motor 200 based on the information on the pressure discharged from the swing motor 200 before passing through the first orifice 431 which is detected by the second pressure detection member 411, the information on the pressure of the hydraulic oil having passed through the first orifice 431 which is detected by the third pressure detection member 421, and an area of the first orifice 431 which is set in advance. Specifically, the controller 950 may calculate the flow rate Q of the swing motor discharged from the swing motor 200 based on the following Equation 1 at the time of swing deceleration.

[Equation 1]

$$Q = c_d \cdot A_{ori} \cdot \sqrt{\frac{2 \cdot \Delta p_{ori}}{\rho}} \quad \text{[Equation 1]}$$

In such a case, $C_d$ is a preset constant for a discharge coefficient.

$A_{ori}$ is a predetermined cross-sectional area of the orifice through which the hydraulic oil having been discharged from the swing motor passes.

$\Delta_{pori}$ is a difference between a pressure before passing through the orifice and a pressure after passing through the orifice.

ρ is a preset constant for a density of the hydraulic oil.

Accordingly, the controller 950 may estimate the current swing speed of the swing body based on the calculated flow rate Q of the swing motor without a separate speed sensor.

In addition, the construction machine 101 according to an embodiment of the present invention may further include a storage pressure detection member 660.

The storage pressure detection member 660 may detect the pressure of the hydraulic oil stored in the first accumulator 610. Specifically, the storage pressure detection member 660 may detect the pressure of the hydraulic oil stored into the first accumulator 610. The pressure information detected by the storage pressure detection member 660 may be transmitted to the controller 950.

In addition, the hydraulic oil control valve unit 500 of the construction machine 101 according to an embodiment of the present invention may include a hydraulic oil switch valve member 530 and a first hydraulic oil opening and closing valve member 510.

The hydraulic oil switch valve member 530 may be selectively switched according to the pressure discharged from the swing motor 200. Specifically, one side of the hydraulic oil switch valve member 530 may be connected to the hydraulic line introduced into the swing motor 200, and another side of the hydraulic oil switch valve member 530 may be connected to the hydraulic line discharged from the swing motor 200. Accordingly, the hydraulic oil switch valve member 530 may be selectively switched according to the pressure of the hydraulic oil flowing into the swing motor 200 and the pressure of the hydraulic oil discharged from the swing motor 200.

The first hydraulic oil opening and closing valve member 510 may be disposed between the hydraulic oil switch valve member 530 and the swing valve 300. In addition, the first hydraulic oil opening and closing valve member 510 may guide the hydraulic oil having been discharged from the swing motor 200 and transferred to the hydraulic oil switch valve member 530 to flow to the first accumulator 610 or the swing valve 300.

Specifically, when the swing motor 200 is decelerated, the first hydraulic oil opening and closing valve member 510 is operated by the controller 950 such that the hydraulic oil having been discharged from the swing motor 200 may be guided to be supplied to the first accumulator 610 through the hydraulic oil switch valve member 530 or to be discharged to the tank through the swing valve 300.

Specifically, in a case where the swing motor 200 is decelerated, when the first hydraulic oil opening and closing valve member 510 is opened by the controller 950, the hydraulic oil having been discharged from the swing motor 200 may be discharged to the tank through the swing valve 300. On the other hand, in a case where the first hydraulic oil opening and closing valve member 510 is closed by the controller 950, the hydraulic oil having been discharged from the swing motor 200 may be guided to pass through the hydraulic oil switch valve member 530 and then be supplied to the first accumulator 610.

In addition, in a case where the swing motor 200 is accelerated and the first hydraulic oil opening and closing valve member 510 is closed, the hydraulic oil having been discharged from the swing motor 200 may flow to the second accumulator 620 through the hydraulic oil switch valve member 530 and be stored in the second accumulator 620.

The regeneration control valve 900 may allow the hydraulic oil having passed through the hydraulic oil switch valve member 530 to be guided to the first accumulator 610. Specifically, the regeneration control valve 900 may be disposed between the hydraulic oil switch valve member 530 and the first accumulator 610. In addition, the regeneration control valve 900 may be controlled such that the hydraulic oil having passes through the hydraulic oil switch valve member 530 and stored in the first accumulator 610 is stored in the first accumulator 610 according to the pressure of the hydraulic oil. That is, the regeneration control valve 900 may be controlled by the controller 950.

In addition, the controller 950 of the construction machine 101 according to an embodiment of the present invention controls the regeneration control valve 900.

The controller 950 calculates an outlet pressure of the swing motor $P_e$ based on the calculated flow rate Q of the swing motor and the area of the swing valve 300. Specifically, when there is no swing regenerative system, a spool type valve is used for the swing valve 300, and a spool valve flow path 311 from the swing motor 200 to the tank is designed to be smaller than a flow path for supplying the hydraulic oil from the main pump 100 to the swing motor 200 so as to control the swing speed during the swing deceleration. An area of the spool valve flow path 311 varies according to an operation amount of the operation unit 310 that allows the operator to select the rotational direction and the rotational speed of the swing motor 200. Accordingly, the area of the spool valve flow path 311 through which the flow rate passes from the swing motor 200 to the tank is preset in the controller 950 according to the operation amount of the operation unit 310.

That is, the controller 950 calculates the outlet pressure of the swing motor $P_e$ when the hydraulic oil currently discharged from the swing motor 200 is discharged to the tank through the swing valve 300 based on the calculated flow rate Q of the swing motor and the preset area of the spool valve flow path 311 and according to the current operation of the operation unit 310.

Specifically, the controller 950 may calculate the outlet pressure of the swing motor $P_e$ based on the following Equation 2.

[Equation 2]

$$P_e = \frac{\rho}{2} \cdot \left( \frac{Q}{c_d \cdot A_{ct}} \right) \quad \text{[Equation 2]}$$

In such a case, p is a preset constant for a density of the hydraulic oil.

$C_d$ is a preset constant for an emission coefficient.

Q is the flow rate of the swing motor discharged from the swing motor calculated by the above Equation 1.

$A_{ct}$ is a preset current area of the spool valve flow path.

In addition, the controller 950 calculates a value obtained by subtracting a pressure of the hydraulic oil stored in the first accumulator 610 detected by the storage pressure detection member 660 from the calculated outlet pressure of the swing motor $P_e$. That is, the controller 950 calculates a difference between the outlet pressure of the swing motor $P_e$ and the pressure of the first accumulator 610. Specifically, the controller 950 may calculate the pressure of the regeneration control valve 900 based on the following Equation 3.

$$P_{relief} = P_e - P_{1accu} \quad \text{Equation 3}$$

In such a case, $P_e$ is the outlet pressure of the swing motor calculated by the above Equation 2.

$P_{1accu}$ is a pressure of the first accumulator.

That is, the controller 950 may control the regeneration control valve 900 such that the pressure of the regeneration control valve 900 and the pressure of the first accumulator 610 become the outlet pressure of the swing motor $P_e$.

In addition, the controller 950 of the construction machine 101 according to an embodiment of the present invention may control the first hydraulic oil opening and closing valve member 510 so that the hydraulic oil having passed through the hydraulic oil switch valve member 530 flows to the swing valve 300 when the outlet pressure of the swing motor $P_e$ is less than the pressure of the first accumulator 610.

The controller 950 determines that the hydraulic oil having been discharged from the swing motor 200 cannot be stored in the first accumulator 610, when the outlet pressure of the swing motor $P_e$ is less than the pressure of the hydraulic oil stored in the first accumulator 610. In this case, the controller 950 opens the first hydraulic oil opening and closing valve member 510 to guide the hydraulic oil having been discharged from the swing motor 200 to be discharged to the tank through the swing valve 300, not to the first accumulator 610.

In addition, the construction machine 101 according to an embodiment of the present invention may further include a regenerative motor 800 and an accumulator valve 650.

The regenerative motor 800 may transmit a power to drive the main pump 100. In addition, the regenerative motor 800 may be driven using the hydraulic oil stored in the first accumulator 610. That is, the energy of the hydraulic oil stored in the first accumulator 610 may be utilized to drive the regenerative motor 800.

The accumulator valve 650 may be disposed between the regenerative motor 800 and the first accumulator 610. In addition, the accumulator valve 650 is open when the hydraulic oil flows to the first accumulator 610 to be stored in the first accumulator 610. The accumulator valve 650 may be open when the hydraulic oil stored in the first accumulator 610 is supplied to the regenerative motor 800. In addition, the accumulator valve 650 may be closed when the first accumulator 610 does not store the hydraulic oil to prevent the hydraulic oil stored in the first accumulator 610 from being discharged therefrom.

In addition, the hydraulic oil switch valve member 530 of the construction machine 101 according to an embodiment of the present invention may supply the hydraulic oil stored in the second accumulator 620 to the swing motor 200 when the swing motor 200 abruptly decelerates.

Specifically, in a case where regeneration is performed when the swing motor 200 is decelerated, the flow rate having been discharged from the swing motor 200 may be stored in the first accumulator 610. In such a case, the hydraulic oil is not supplied to the inflow side of the swing motor 200 when the swing motor 200 rotates, and cavitation may occur on the inflow side of the swing motor 200.

However, when the swing motor 200 accelerates, the hydraulic oil having been stored in the second accumulator 620, which can store the hydraulic oil discharged from the swing motor 200, may be supplied to the inflow side of the swing motor 200. Accordingly, when the swing motor 200 is decelerated, the hydraulic oil having been stored in the second accumulator 620 may be supplied to the swing motor 200, and the flow rate discharged from the swing motor 200 may be stored in the first accumulator 610.

In addition, the hydraulic oil control valve unit 500 of the construction machine 101 according to an embodiment of the present invention may further include a second hydraulic oil opening and closing valve member 520. Specifically, the second hydraulic oil opening and closing valve member 520 may be disposed between the hydraulic oil switch valve member 530 and the swing valve 300. In addition, the second hydraulic oil opening and closing valve member 520 may be spaced apart from the first hydraulic oil opening and closing valve member 510. The second hydraulic oil opening and closing valve member 520 has the same function as the function of the first hydraulic oil opening and closing valve member 510 but may be controlled according to the rotation direction of the swing motor 200.

Figure 5:
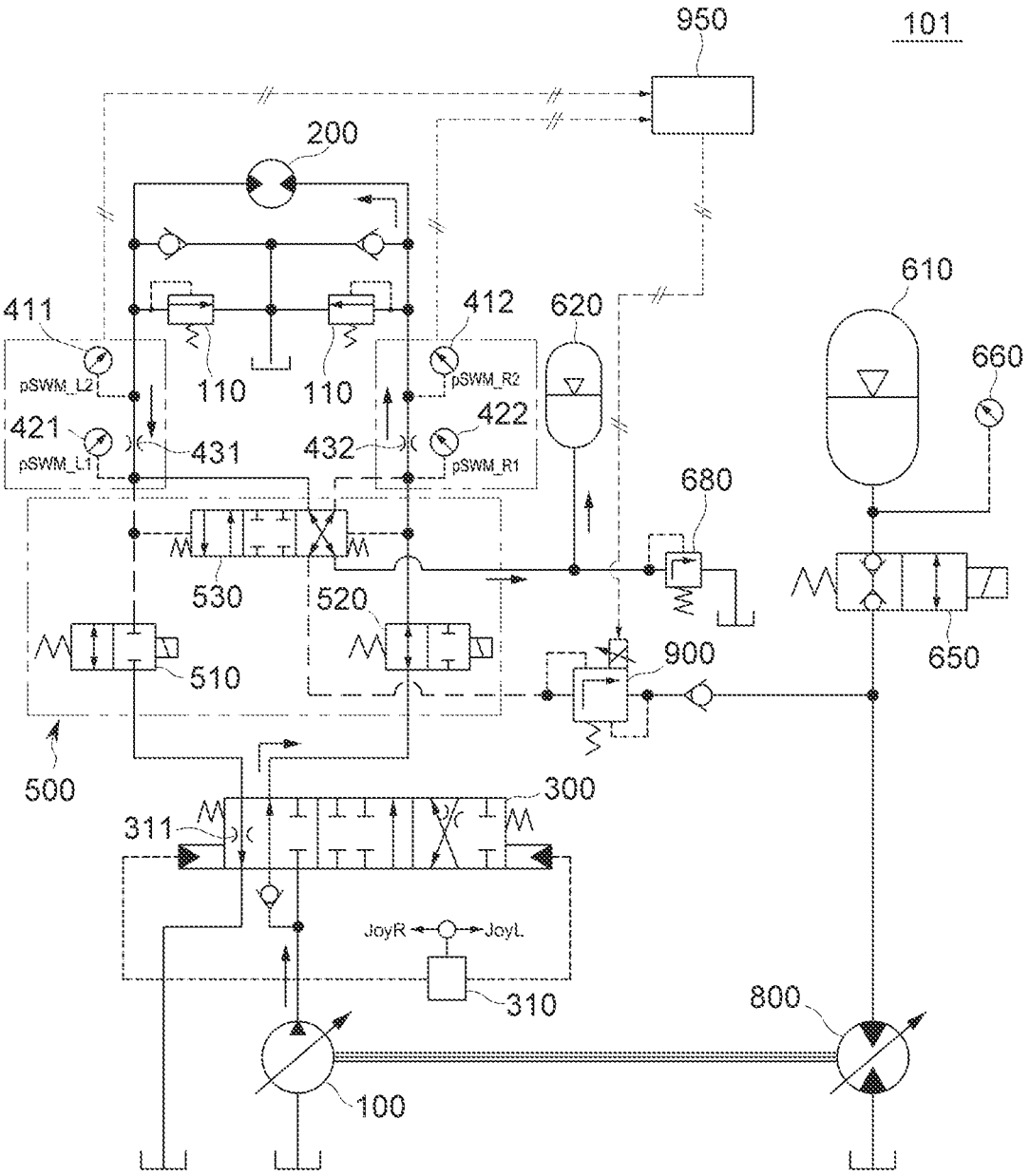
FIG. 5 is a diagram illustrating a swing body of FIG. 3 at the time of acceleration.

In addition, the construction machine 101 according to an embodiment of the present invention may further include a fourth pressure detection member 422 and a second orifice 432, as illustrated in FIGS. 3 and 5.

The fourth pressure detection member 422 may be disposed between the hydraulic oil switch valve member 530 and the swing motor 200. Specifically, the fourth pressure detection member 422 may be disposed between the first pressure detection member 412 and the hydraulic oil switch valve member 530.

The second orifice 432 may be disposed between the first pressure detection member 412 and the second pressure detection member 411. In addition, an area of the second orifice 432 may be preset in the controller 950.

For example, when the rotation direction of the swing motor 200 is the right side, as illustrated in FIG. 5, the controller 950 may calculate the flow rate of the swing motor based on the pressure of the hydraulic oil detected by the second pressure detection member 411 and the third pressure detection member 421, and the preset area of the first orifice 431.

On the other hand, when the rotation direction of the swing motor 200 is the right side, as illustrated in FIG. 5, the controller 950 may calculate the flow rate of the swing motor based on the pressure R1 of the hydraulic oil detected by the first pressure detection member 412 and the fourth pressure detection member 422 and the preset area of the second orifice 432.

That is, as illustrated in FIG. 3, the plurality of orifices and the plurality of pressure detection members, provided at opposite ends of the plurality of orifices, may allow detection of the hydraulic oil discharged from the swing motor 200 and allow calculation of the flow rate thereof, since the hydraulic oil is supplied in different directions with respect to the swing motor 200 according to the moving direction of the swing body.

Figure 2:
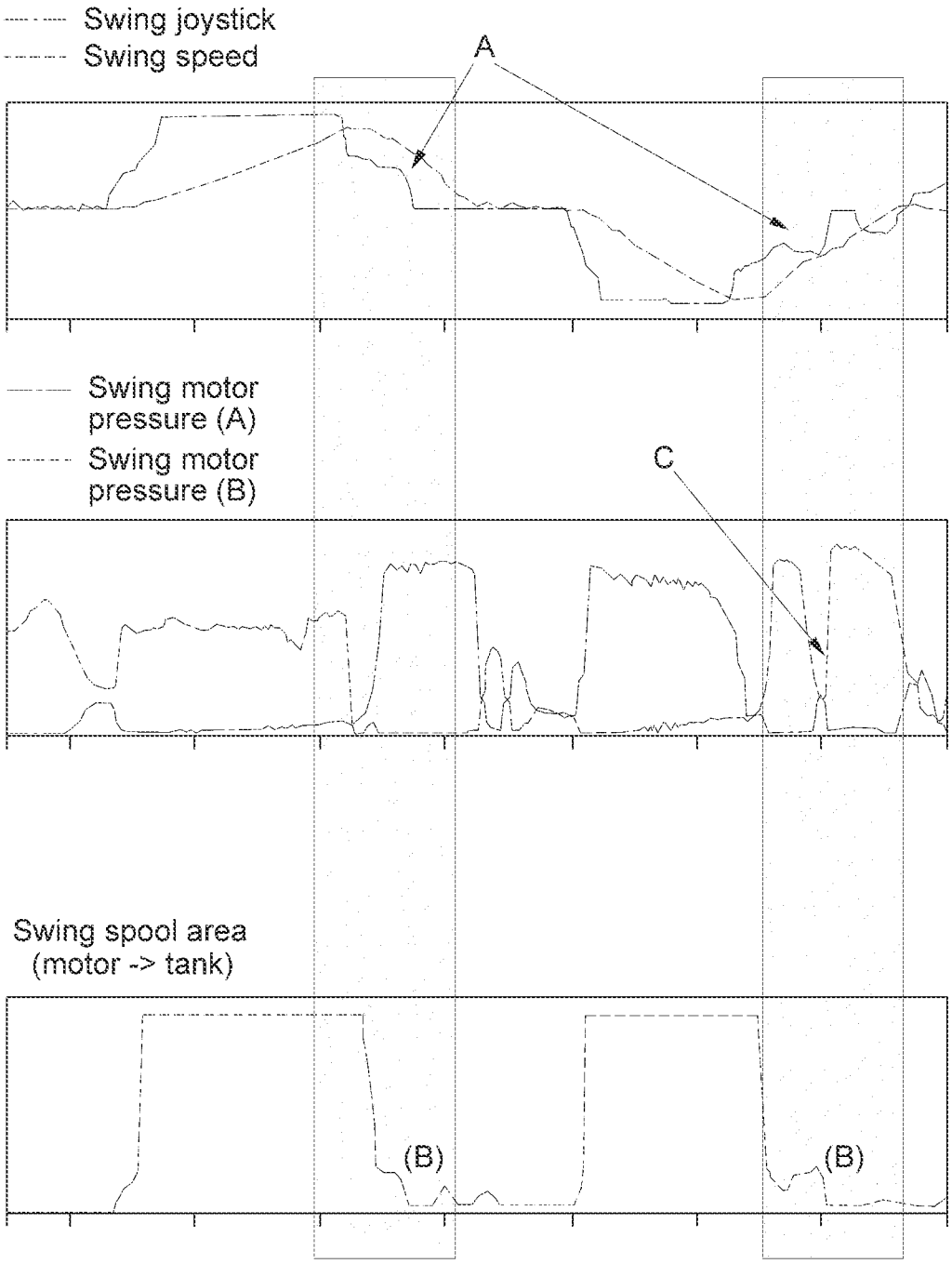
FIG. 2 shows an operation state of FIG. 1.

In other words, with respect to FIG. 3, when the controller 950 receives information from the operation unit 310 so that the swing body rotates to the left, the pressure detection member 411 disposed on the left side of the swing motor 200 of FIG. 3 may detect the pressure of the hydraulic oil flowing into the swing motor 200, and the pressure detection member 412 disposed on the right side of the swing motor 200 of FIG. 2 may detect the pressure of the hydraulic oil discharged from the swing motor 200. In such a case, the first pressure detection member for detecting the pressure of the hydraulic oil flowing into the swing motor 200 may be reference numeral 411 in FIG. 3, and the second pressure detection member for detecting the pressure of the hydraulic oil discharged from the swing motor 200 may be reference numeral 412 in FIG. 3.

Figure 7:
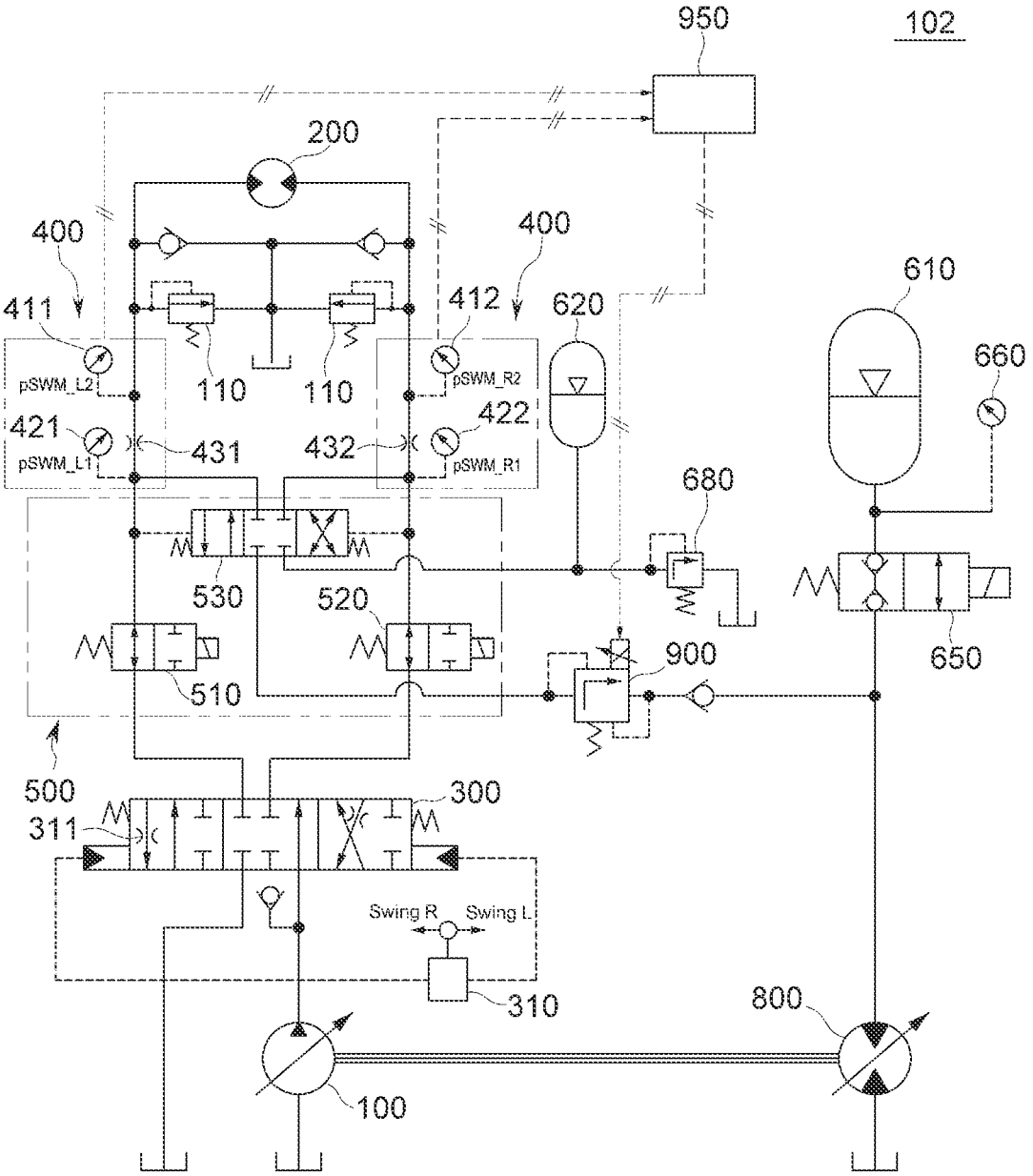
FIG. 7 is a view illustrating a construction machine according to another embodiment of the present invention.

Alternatively, a construction machine 102 according to another embodiment of the present invention, as illustrated in FIG. 7, includes the main pump 100, the swing motor 200, the swing valve 300, the hydraulic oil control valve unit 500, a flow rate detection member 400, the first accumulator 610, the regeneration control valve 900, and the controller 950. Detailed configuration except for the flow rate detection member 400 of the construction machine 102 according to another embodiment of the present invention may be the same as the configuration of the construction machine 101 according to an embodiment of the present invention described above.

Specifically, the flow rate detection member 400 of the construction machine 102 according to another embodiment of the present invention is provided between the swing motor 200 and the hydraulic oil control valve unit 500. In addition, the flow rate detection member 400 may detect the flow rate of the hydraulic oil discharged from the swing motor 200.

In addition, the flow rate detection member 400 may include a plurality of flow rate detection members spaced apart from each other around the swing motor 200 between the swing motor 200 and the hydraulic oil control valve unit 500. Accordingly, the flow rate detection member 400 may detect the flow rate of the hydraulic oil discharged from the swing motor 200 regardless of the rotation direction of the swing motor 200.

That is, the controller 950 of the construction machine 102 according to another embodiment of the present invention may be provided with the flow rate of the hydraulic oil discharged from the swing motor 200, from the information detected by the flow rate detection member 400. In addition, the controller 950 of the construction machine 102 according to another embodiment of the present invention may calculate, like the controller 950 of the construction machine 101 described above, the outlet pressure of the swing motor $P_e$ and a control pressure of the regeneration control valve 900.

Hereinafter, the operation of the construction machine 101 according to an embodiment of the present invention will be described with reference to FIGS. 3 to 6.

FIG. 5 shows the acceleration of the swing motor 200 of the construction machine 101.

When the swing body swings to the right and acceleration is desired, the swing valve 300 moves to the right and is switched by the operation unit 310 operated by the operator.

Since the swing body operates as a load during acceleration, high pressure is formed in the hydraulic line supplied from the main pump 100 to the swing motor 200, and low pressure is formed in the hydraulic line passing through the swing motor 200 and discharged therefrom.

When the swing motor 200 is accelerated, the pressure of the hydraulic oil supplied to the swing motor 200 is higher than the pressure discharged from the swing motor 200. Accordingly, the hydraulic oil switch valve member 530 moves to the left and is switched.

The hydraulic oil supplied from the main pump 100 may be supplied to the swing motor 200, and the hydraulic oil having been discharged from the swing motor 200 may be transferred to the hydraulic oil switch valve member 530.

The controller 950 detects the current acceleration state of the swing motor based on the information of the operation unit 310, the pressure of the hydraulic oil supplied to the swing motor 200 detected from the first pressure detection member 412, and the pressure of the hydraulic oil discharged from the swing motor 200 detected from the second pressure detection member 411. Accordingly, the controller 950 determines that the swing motor 200 is accelerated when the pressure detected by the first pressure detection member 412 is greater than the pressure detected by the second pressure detection member 411.

In such a case, the first hydraulic oil opening and closing valve member 510 is closed by the controller 950. That is, the hydraulic oil having been discharged from the swing motor 200 is stored in the second accumulator 620 through the hydraulic oil switch valve member 530. In addition, the hydraulic oil having been discharged from the swing motor 200 is blocked from being discharged to the tank through the swing valve 300 by the closed first hydraulic oil opening and closing valve member 510.

The hydraulic oil having been discharged from the swing motor 200 is transferred to the discharge oil of the hydraulic oil switch valve member 530. In addition, the hydraulic oil having passed through a discharge flow path of the hydraulic oil switch valve member 530 is supplied to the second accumulator 620. That is, the low-pressure hydraulic oil having been discharged from the swing motor 200 is stored in the second accumulator 620. Specifically, the construction machine 101 may further include a low pressure relief valve 680 for discharging the hydraulic oil, having been supplied to the second accumulator 620, to the tank when the pressure of the hydraulic oil is higher than a preset pressure.

In addition, during swing acceleration, the controller 950 controls the regeneration control valve 900 to the maximum pressure so that the low-pressure hydraulic oil having passed through the hydraulic oil switch valve member 530 cannot flow to the first accumulator. For example, the control pressure of the regeneration control valve 900 may be a pressure higher than the opening pressure of the swing relief valve 110.

Accordingly, upon acceleration of the swing motor 200, the construction machine 101 may store, in the second accumulator 620, the hydraulic oil, having been discharged from the swing motor 200, which has a pressure relatively lower than the pressure of the hydraulic oil flowing into the swing motor 200.

Figure 6:
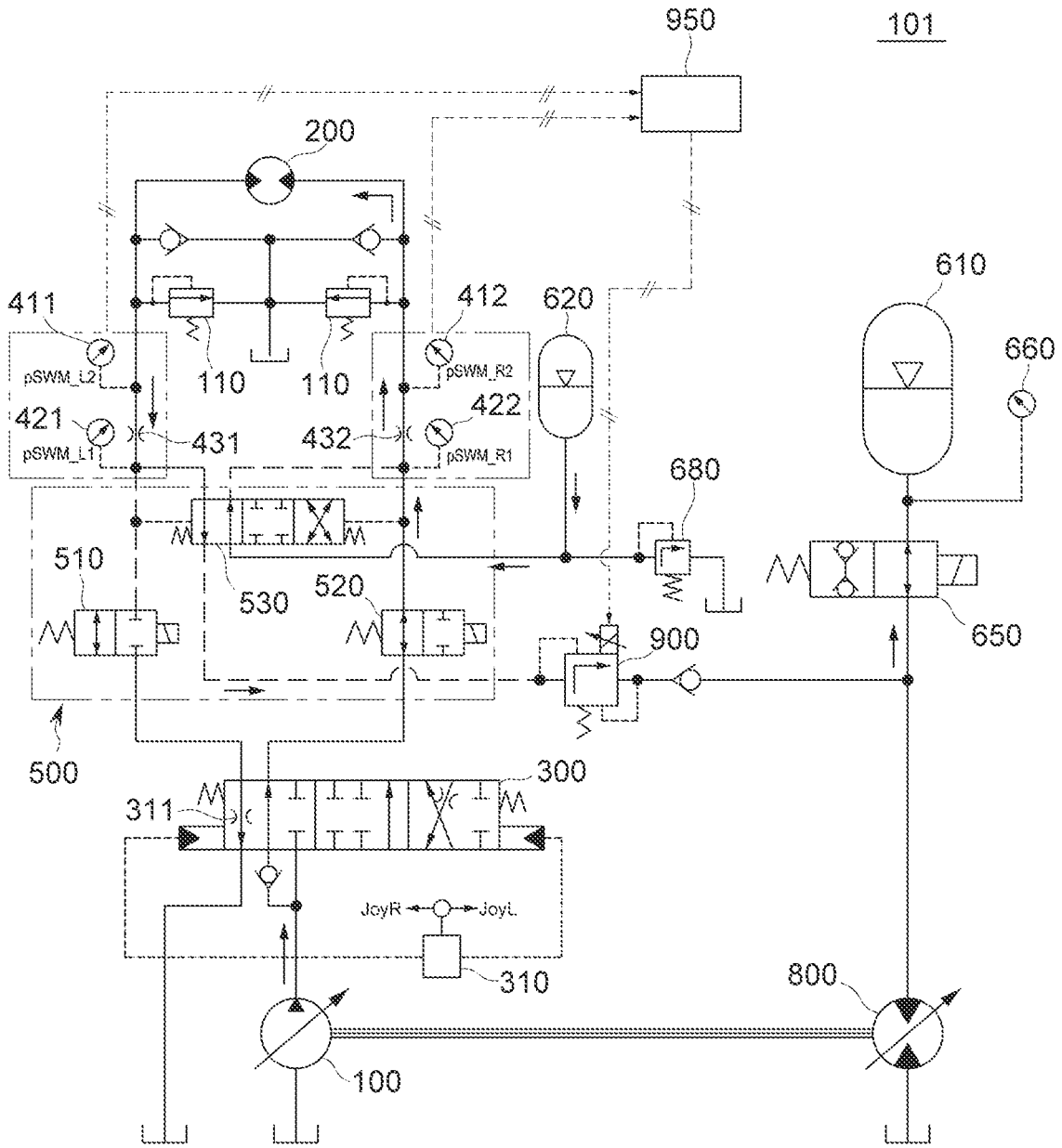
FIG. 6 is a view illustrating a swing body at the time of deceleration according to an embodiment of the present invention.

FIG. 6 shows the deceleration of the swing motor 200 of the construction machine 101.

If the swing body rotates to the right after the swing acceleration and deceleration is desired, the operation amount of the operation unit 310 operated by the operator is reduced and the swing valve 300 moves to the right to maintain the switched state, but the amount of movement becomes less than the case of swing acceleration. Accordingly, the spool valve flow path 311 of the swing valve 300 for the hydraulic oil having been discharged from the swing motor 200 to pass through toward the tank is reduced. However, at the time of swing deceleration, the swing body continues to rotate by inertia, whereby the swing motor 200 continues to rotate and discharges the hydraulic oil. Accordingly, the pressure on the discharge side of the swing motor 200 increases due to the reduced area of the spool valve flow path 311.

The elevated pressure of the hydraulic oil is transmitted to the hydraulic oil switch valve member 530. The hydraulic oil switch valve member 530 is switched by a pressure difference between one side of the hydraulic oil switch valve member 530 and another side of the hydraulic oil switch valve member 530.

When the swing motor 200 is decelerated, the pressure of the hydraulic oil discharged from the swing motor 200 is higher than the pressure of the hydraulic oil supplied to the swing motor 200. Accordingly, the hydraulic oil switch valve member 530 moves to the right and is switched. In such a case, the hydraulic oil stored in the second accumulator 620 is also supplied to the swing motor 200 through the switched hydraulic oil switch valve member 530. Specifically, by the hydraulic oil switch valve member 530, the hydraulic oil which is stored when the swing motor 200 is accelerated may be supplied to the swing motor 200 and utilized by supplying the hydraulic oil stored in the second accumulator 620 to the swing motor 200 when the swing motor 200 is decelerated. The controller 950 detects the current deceleration state of the swing motor 200 based on the pressure of the hydraulic oil supplied to the swing motor 200 detected from the first pressure detection member 412, and the pressure of the hydraulic oil detected from the swing motor 200 detected from the second pressure detection member 411. Accordingly, the controller 950 determines that the swing motor 200 is decelerated when the pressure detected by the second pressure detection member 411 is greater than the pressure detected by the first pressure detection member 412.

The controller 950 calculates the swing motor flow rate Q, which is the flow rate of the hydraulic oil currently being discharged from the current swing motor 200, based on the pressure of the hydraulic oil, discharged from the swing motor 200, detected by the second pressure detection member 411 and the pressure of the hydraulic oil, having passed through the first orifice 431, detected by the third pressure detection member 421, and the preset area of the first orifice 431.

In addition, the controller 950 calculates the outlet pressure of the swing motor $P_e$ of the case where the flow rate discharged from the motor 200 is discharged to the tank through the spool valve flow path 311, based on the preset area of the spool valve flow path 311 which varies according to the calculated operation amount of the current operation unit 310 provided in the swing valve 300 and the calculated swing motor flow rate Q.

The controller 950 then controls the regeneration control valve 900. Specifically, the controller 950 includes the regeneration control valve 900 such that a pressure loss corresponding to a pressure difference between the motor outlet pressure $P_e$ and the pressure of the hydraulic oil of the first accumulator 610 detected by the storage pressure detection member 660 may occur.

As described above, the controller 950 may predict the motor outlet pressure $P_e$, which is the pressure of the discharge side of the swing motor 200 when the swing deceleration is performed in the absence of the swing regenerative system and may use it as a control target pressure in the swing regenerative system. That is, the control target pressure is utilized for the control of the regeneration control valve 900, and the controller 950 may maintain the swing deceleration sensitivity by the swing regenerative system of the construction machine 101, like the case where there is no swing regenerative system.

In addition, during swing deceleration, the controller 950 may close the first hydraulic oil opening and closing valve member 510 when the estimated motor outlet pressure $P_e$ is higher than the pressure of the first accumulator 610 so that the hydraulic oil having passed through the hydraulic oil switch valve member 530 may be stored in the first accumulator 610. In such a case, the accumulator valve 650 may be open.

The high-pressure hydraulic oil stored in the first accumulator 610 may be supplied to the regenerative motor 800 to assist the driving force during the operation of the main pump 100, when swing acceleration or other heavy load work is performed.

That is, during swing deceleration, the controller 950 may first provide the flow rate of the hydraulic oil provided from the main pump 100 to the introduction side of the swing motor 200, and the insufficient portion of the hydraulic oil may be provided from the second accumulator 620.

On the other hand, when the motor outlet pressure $P_e$ is less than the pressure of the first accumulator 610, the controller 950 may open the first hydraulic oil opening and closing valve member 510 to guide the hydraulic oil having been discharged from the swing motor 200 to be discharged to the tank through the swing valve 300. In such a case, the regeneration control valve 900 may maintain a closed state.

With such a configuration, the construction machine 101 according to an embodiment of the present invention may store the hydraulic oil in the first accumulator 610 during deceleration of the swing body according to the pressure of the hydraulic oil having passed through the swing motor 200 and may utilize the hydraulic oil stored in the first accumulator 610 when operating the regenerative motor 800.

In addition, the construction machine 101 may store the hydraulic oil having passed through the swing motor 200 in the second accumulator 620 during acceleration of the swing body and may supply the hydraulic oil to the swing motor 200 when the swing body decelerates.

Although the embodiments of the present invention have been described above with reference to the accompanying drawings, those skilled in the art to which the present invention pertains can understand that the present invention can be implemented in other specific forms without changing the technical spirit or essential features.

The foregoing description is merely illustrative of the present invention, and various modifications may be made by those skilled in the art without departing from the spirit of the present invention. Accordingly, the embodiments disclosed herein are not intended to limit the present invention. The scope of the present invention should be construed according to the following claims, and all changes or modifications derived from the meaning and scope of the claims and their equivalents should be construed as being included in the scope of the present invention.

INDUSTRIAL APPLICABILITY

A construction machine according to an embodiment may store a hydraulic oil having been discharged from a swing motor at the time of deceleration or acceleration of a swing body to effectively utilize the energy of the hydraulic oil.

The invention claimed is:

1. A construction machine, comprising:

a main pump;

a swing motor operated by receiving a hydraulic oil from the main pump;

a swing valve configured to control flow of the hydraulic oil by the main pump to supply the hydraulic oil to the swing motor and to control the flow of the hydraulic oil having been discharged from the swing motor;

a hydraulic oil control valve unit provided between the swing motor and the swing valve and configured to control the flow of the hydraulic oil according to a pressure of the hydraulic oil at opposite ends;

a first accumulator configured to store the hydraulic oil having passed through the hydraulic oil control valve unit when the swing motor is decelerated;

a regeneration control valve provided between the hydraulic oil control valve unit and the first accumulator;

a regenerative motor which is drivable by the hydraulic oil stored in the first accumulator;

an accumulator valve disposed between the regenerative motor and the first accumulator, the accumulator valve being opened and closed according to supply of the hydraulic oil to be stored in the first accumulator; and a controller configured to control the hydraulic oil control valve unit and the regeneration control valve by determining acceleration or deceleration of the swing motor.

2. The construction machine of claim 1, further comprising a second accumulator capable of storing the hydraulic oil having passed through the hydraulic oil control valve unit when the swing motor accelerates.

3. The construction machine of claim 1, further comprising a storage pressure detection member configured to detect a pressure of the hydraulic oil stored in the first accumulator by the opening of the accumulator valve and to transmit the pressure to the controller.

4. The construction machine of claim 1, wherein the hydraulic oil control valve unit comprises: a hydraulic oil switch valve member that is selectively switched according to the pressure of the hydraulic oil discharged from the swing motor and the pressure of the hydraulic oil supplied to the swing motor.

5. A construction machine, comprising:

a main pump;

a swing motor operated by receiving a hydraulic oil from the main pump;

a swing valve configured to control flow of the hydraulic oil by the main pump to supply the hydraulic oil to the swing motor and to control the flow of the hydraulic oil having been discharged from the swing motor;

a hydraulic oil control valve unit provided between the swing motor and the swing valve and configured to control the flow of the hydraulic oil according to a pressure of the hydraulic oil at opposite ends;

a first accumulator configured to store the hydraulic oil having passed through the hydraulic oil control valve unit when the swing motor is decelerated;

a regeneration control valve provided between the hydraulic oil control valve unit and the first accumulator;

a regenerative motor which is drivable by the hydraulic oil stored in the first accumulator;

a controller configured to control the hydraulic oil control valve unit and the regeneration control valve by determining acceleration or deceleration of the swing motor; and a first pressure detection member provided between the swing motor and the swing valve and configured to detect a pressure of the hydraulic oil flowing into the swing motor;

a second pressure detection member configured to detect a pressure discharged from the swing motor;

a first orifice provided between the second pressure detection member and the swing valve, the hydraulic oil passing through the first orifice; and a third pressure detection member provided between the first orifice and the swing valve, wherein the controller calculates a flow rate of the swing motor based on the pressure of the hydraulic oil detected by the second pressure detection member and the third pressure detection member and a preset area of the first orifice, and calculates an outlet pressure of the swing motor based on the calculated flow rate of the swing motor and a preset area of the swing valve so as to control the regeneration control valve based on a difference between the calculated outlet pressure of the swing motor and the pressure of the first accumulator.

6. The construction machine of claim 5, wherein when the calculated outlet pressure of the swing motor is higher than the pressure of the first accumulator, the controller closes the first hydraulic oil opening and closing valve member, and controls the regeneration control valve so that a pressure loss corresponding to the difference between the calculated outlet pressure of the swing motor and the pressure of the hydraulic oil of the first accumulator occurs.

7. The construction machine of claim 5, wherein when the calculated outlet pressure of the swing motor is less than the pressure of the first accumulator, the controller controls the first hydraulic oil opening and closing valve member or the second hydraulic oil opening and closing valve member so that the hydraulic oil having been discharged from the swing motor flows to the swing valve.

8. A construction machine, comprising:

a main pump;

a swing motor operated by receiving a hydraulic oil from the main pump;

a swing valve configured to control flow of the hydraulic oil by the main pump to supply the hydraulic oil to the swing motor and to control the flow of the hydraulic oil having been discharged from the swing motor;

a hydraulic oil control valve unit provided between the swing motor and the swing valve and configured to control the flow of the hydraulic oil according to a pressure of the hydraulic oil at opposite ends;

a first accumulator configured to store the hydraulic oil having passed through the hydraulic oil control valve unit when the swing motor is decelerated;

a regeneration control valve provided between the hydraulic oil control valve unit and the first accumulator;

a regenerative motor which is drivable by the hydraulic oil stored in the first accumulator;

a controller configured to control the hydraulic oil control valve unit and the regeneration control valve by determining acceleration or deceleration of the swing motor; and a flow rate detection member provided between the swing motor and the hydraulic oil control valve unit.

* * * * *